US005240049A

United States Patent [19]

Chiari

[11] Patent Number: 5,240,049

[45] Date of Patent: Aug. 31, 1993

[54] MACHINE FOR THE DOSAGE AND INTRODUCTION OF POWDER PRODUCTS INTO CONTAINERS

[75] Inventor: Franco Chiari, Bologna, Italy

[73] Assignee: Macofar S.p.A., Rastignano, Italy

[21] Appl. No.: 801,287

[22] Filed: Dec. 2, 1991

[30] Foreign Application Priority Data

Dec. 7, 1990 [IT] Italy ..... 3769A/90

[51] Int. Cl.[5] ..... B65B 1/24

[52] U.S. Cl. ..... 141/81; 141/71; 141/258; 141/144; 141/181; 141/270

[58] Field of Search ..... 141/11, 12, 65, 69, 141/71, 81, 144, 145, 146, 147, 181, 270, 283, 284, 258; 53/438, 529, 560, 900

[56] References Cited

U.S. PATENT DOCUMENTS

| | | | |
|---|---|---|---|
| 3,192,968 | 7/1965 | Baruch et al. | 141/284 X |
| 3,568,735 | 3/1971 | Lancaster | 141/238 |
| 3,656,517 | 4/1972 | Taylor et al. | 141/144 X |
| 3,656,518 | 4/1972 | Aronson | 141/81 X |
| 3,841,363 | 10/1974 | Stigler | 141/146 X |
| 4,062,386 | 12/1977 | Zanasi | 141/258 |
| 4,116,247 | 9/1978 | Zanasi | 141/81 X |
| 5,111,642 | 5/1992 | Chiari | 53/529 |

*Primary Examiner*—Henry J. Recla
*Assistant Examiner*—Casey Jacyna
*Attorney, Agent, or Firm*—Guido Modiano; Albert Josif

[57] ABSTRACT

The machine for the dosage and introduction of powder products into containers comprises a vertical central shaft, a sleeve guided on the central shaft and a pipe guided on the sleeve. The shaft, the sleeve and the pipe are movable along strokes which are appropriately mutually synchronized. At, least two series of dosage tubes are associated with the pipe and slidably accommodate pistons defining dosage chambers. Actuation cams are provided for actuating in succession the descent stroke of the sleeve and the pipe so as to cause the insertion of the series of tubes in respective annular channels of a hopper mounted around the sleeve in order to fill the dosage chambers with doses of product which are discharged into a plurality of containers after lifting the tubes out of the hopper.

6 Claims, 2 Drawing Sheets 82
83
2
66
69
63
71
80
81
70
62
67
64
68
74
75
72
46
65
86
87
47
73
78
7
79
76
48
30
38
44
77
39
45
54
53
34
29
43
31
8
59
49
35
33
60
84
40
32
50
A
11
37
56
II
85
41
22
42
II
51
21
52
26
17
58
57
28
16
25
12
55
27
6
61
15
14
19
5
4
18
23
24
13
36
3
9
10
20
1
5a
4a
2a

MACHINE FOR THE DOSAGE AND INTRODUCTION OF POWDER PRODUCTS INTO CONTAINERS

BACKGROUND OF THE INVENTION

The present invention relates to a machine for the dosage and introduction of powder products into containers, in particular pharmaceutical powders in capsules.

In current machines, the dosage of powders into capsules is performed by means of a small tube in which a piston slides and delimits the dosage chamber.

By means of cams, the tube is actuated vertically so that it sinks in the powder contained in a hopper until the dosage chamber is filled. The tube is then transferred above a capsule into which the amount of removed powder is expelled when the piston descends.

In known devices there is the disadvantage that the insertion of the tube into the hopper changes the density of the powder, so that more compact regions interspersed with other less compact ones are produced, with the disadvantage that the quantity of the removed doses is not constant but is subject to even significant variations which cannot be tolerated in the pharmaceutical field.

Furthermore, if the powder must be compacted before being introduced in the capsules, lower density can be the cause of insufficient compaction, with the risk that the tablets thus produced may flake, compromising the subsequent packaging operations.

SUMMARY OF THE INVENTION

The aim of the present invention is therefore to obviate the disadvantages of known devices by providing a machine for the dosage of powders into capsules which is suitable for ensuring uniform density of the powder contained in the hopper, so as to eliminate the danger of incorrect dosages.

Within the scope of this aim, a further object of the present invention is to provide a dosage machine which, with respect to current ones, has higher productivity and is relatively simpler in construction and reliable in operation, besides allowing to vary the doses.

This aim and this object are achieved by means of a machine for the dosage and introduction of powder products in containers, which is characterized in that it comprises a substantially vertical central shaft, a sleeve guided on said central shaft and a pipe guided on said sleeve, said shaft, said sleeve and said pipe being movable along strokes which are appropriately mutually synchronized, a support for at least two series of vertical and parallel casings being associated with said pipe, respective dosage tubes being rigidly associated coaxially to said casings in a downward position, respective stems being guided in said casings, said stems being provided, in a downward position, with pistons which are guided in said tubes and define dosage chambers, means for slidingly supporting on said sleeve an equal number of series of rods which are coaxial to said stems and have one end operatively associated with the top of each stem, actuation means for actuating in succession the descent stroke to said sleeve and said pipe so as to cause the insertion of the series of tubes in respective annular channels of a hopper mounted around said sleeve in order to fill the dosage chambers with doses of product, an ascent stroke of said pipe and said sleeve suitable for lifting the tubes out of the hopper above a plurality of containers for receiving the doses of product, and finally a descent stroke of the central shaft suitable for moving abutments fixed to said central shaft so that they act on said rods so as to cause the descent of the pistons in order to expel the doses into the underlying containers, actuation means being finally provided for rotating said hopper about said sleeve.

BRIEF DESCRIPTION OF THE DRAWINGS

Further details of the invention will become apparent from the detailed description of a preferred embodiment of a machine for the dosage of powders, illustrated by way of non-limitative example in the accompanying drawing, wherein.

DESCRIPTION OF THE PREFERRED EMBODIMENTS

Figure 1:
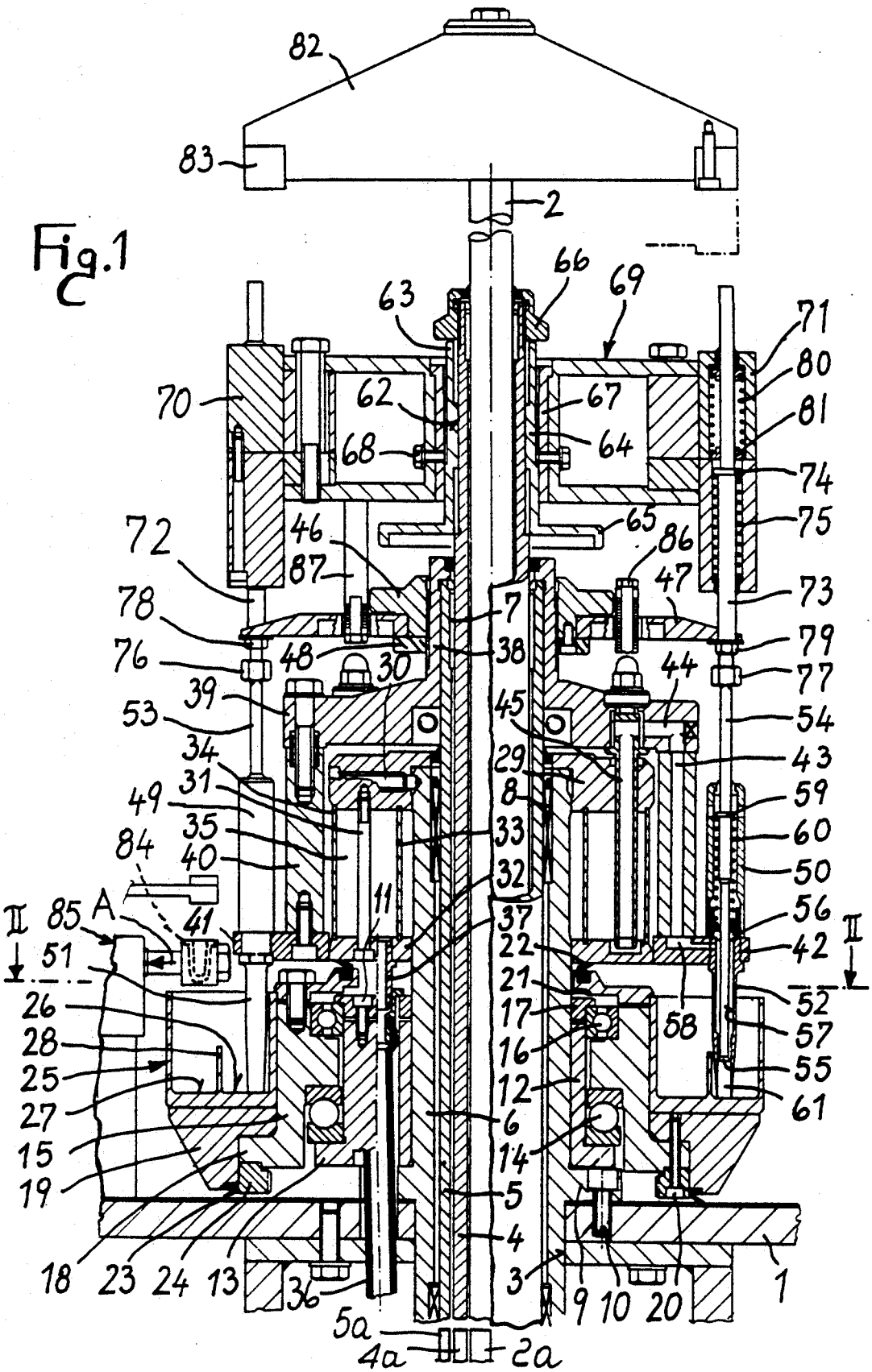
FIG. 1 is a sectional elevation view of the machine according to the invention.
Figure 2:
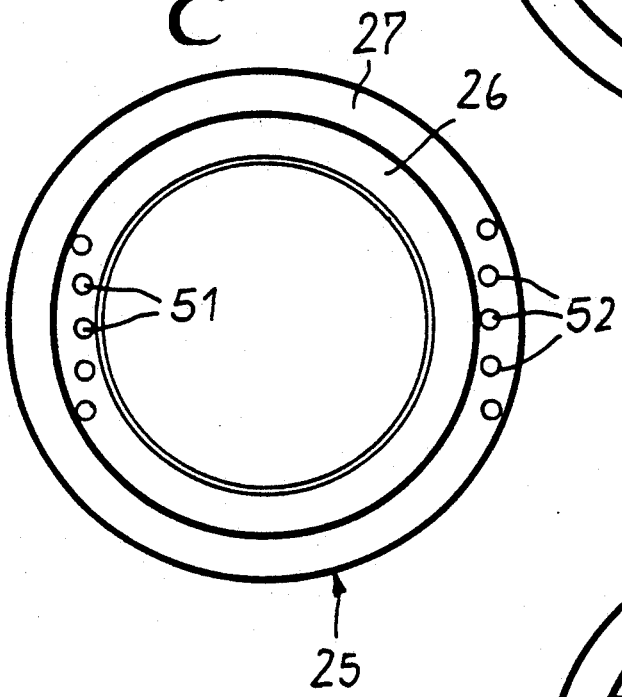
FIG. 2 is a schematic plan view of the machine of FIG. 1 taken along the plane II—II and finally

With reference to FIGS. 1 and 2, the machine comprises a base which is provided, in an upward position, with a horizontal plane 1 in which an opening 3 is defined; a shaft 2 and a sleeve 4 extend vertically through said opening 3, and said sleeve 4 covers, for part of its length, the shaft 2 and is in turn partially covered by a pipe 5.

Finally, a tubular column 6 is centered in the opening 3, is coaxial to the pipe 5 and is lower than said pipe. In practice, therefore, while the shaft 2 extends from the sleeve 4, the sleeve 4 protrudes upward from the pipe 5 and said pipe 5 protrudes upward from the tubular column 6.

The sleeve 4, the pipe 5 and the shaft 2 are connected to respective cam means 4*a*, 5*a* and 2*a* which impart thereto vertical reciprocating strokes of preset and adjustable length. In order to allow said strokes, a pair of bushings 7 is interposed between the sleeve 4 and the pipe 5, whereas a pair of bushings 8, accommodated in annular seats defined inside the column 6, is provided between the pipe 5 and the column 6.

The tubular column 6 is provided with a flange 9 with which it rests on the plane 1; the flange 9 is fixed to said plane 1 by means of screws 10. A tubular body 12 is arranged on the column 6 eccentrically with respect to the axis of said column by means of pins 11 and screws which are not visible in the drawing; the lower edge of said tubular body 12 defines a lip 13 which is directed outward.

A drum 15 rests on the lip 13 by means of a thrust bearing 14 and is radially supported by a bearing 16 which is retained by a ring 17. The drum 15 is coaxial to the body 12 and is thus eccentric with respect to the shaft 2, and has a lower flange 18 which protrudes outward and on which a frustrum-shaped ring 19 rests; said ring 19 is fixed with screws 20. A pivoting ring 21 is fixed on the upper edge of the drum 15 and is provided with an axial sealing gasket 22 which covers the bearing 16.

A similar gasket 23, accommodated in a seat of the body 19, is in sealing contact on the plane 1 in order to prevent the penetration of foreign matter toward the bearing 14.

A crown gear 24 with inward teeth is rigidly associated below the drum 15 by means of the same screws 20 and meshes with a pinion, not illustrated in the drawing, for the intermittent actuation of the drum 15.

A torroidal-shaped hopper 25 rests on the frustrum-shaped body 19 and is internally retained by the pivoting ring 21. It is believed to be implicit to one skilled in the art that the pinion which meshes with the crown gear 24 can be driven by any suitable conventional motor means for causing intermittent actuation of the drum 15, together with the pivoting ring 21 which is fixed to the upper edge of the drum 15. Such actuation of the drum 15 and pivoting ring 21 causes rotation of the hopper 25 which is inwardly fixed to the pivoting ring 21 (see FIG. 1). Said hopper 25 is open upward and is internally divided into two concentric annular channels 26 and 27 by a cylindrical vertical partition 28.

A coaxial disk 29 is arranged above the top of the tubular column 6 and is locked by means of radial screws 30. A disk 32 is associated with, and spaced from, the lower face of the disk 29 by means of bolts 31 and is centered on the column 6. Two cylindrical concentric walls 33 and 34 are arranged between the disk 29 and the disk 32 and sealingly enclose a compartment 35. The compartment 35 can be connected to a suction source through a duct 36 which passes through the plane 1, axially crosses the thicker region of the tubular body 12 and enters the compartment 35 by means of a coupling 37 which is mounted in the disk 32.

A bell-shaped body is sealingly arranged above the upper terminal portion of the pipe 5 and is formed by a bush 38 which is rotatably fixed thereon and is provided, in a downward position, with a disk 39 larger in diameter than the disk 29. A cylindrical wall 40 extends downward from the periphery of the disk 39, and two brackets 41, 42 are rigidly associated therewith in diametrically opposite downward positions, are co-planar with respect to the disk 32; one protrudes above the channel 26 and the other one protrudes above the channel 27. An internal channel 43 is defined in the wall 40 at each bracket 41 and 42 and is connected, in an upward position, to a respective hole 44 defined radially in the disk 39. A vertical tube 45 is connected to each hole, slidingly passes through the disk 29 and enters the chamber 35.

A ring 46 is engaged with a screw coupling on the bush 38, and a seat is defined in its lower face; said seat is engaged by a cross-member 47 which is retained by means of a ring 48 coupled to the lower face of the ring by means of screws.

The ring 46 can rotate in the cross-member 47, so that said cross-member can be raised or lowered with respect to the disk 39 when the ring is screwed or unscrewed.

Two series of vertical parallel tubular casings 49 and 50 are rigidly associated with the brackets 41 and 42 and extend downward with respective tubes 51 and 52 which are associated therewith.

Stems 53, 54 are guided in the casings 49 and 50 and in the tubes 51 and 52 and are provided with pistons 55 at their lower ends. The stems are sealingly guided in gaskets 56 which upwardly close respective cylindrical interspaces 57 defined between the walls of the tubes 51, 52 and the portions of the stems which are internal to said tubes. The interspaces 57 are connected to respective passages 58 which merge in the channel 43. In the illustrated example, as more clearly shown in FIG. 2, five casings 49 and 50 are provided on each bracket 41 and 42 and are aligned in a plane which is tangent to the partition 28 and to the inner wall of the chamber 26 respectively.

Inside the casings 49 and 50, each stem 53 and 54 is provided with a collar 59 which constitutes an upper abutment for a spring 60 which rests in a downward position on the gasket 56. In this manner, the springs 60 keep the stems 53 and 54 in a normally raised position which forms, at the lower end of the tubes, a chamber 61 which constitutes the chamber for the dosage of the powder product. A seat 62 is defined in the upper part of the sleeve 4, and a sleeve 64 provided with a handwheel 65 is rotatably mounted in said seat 62 by means of bearings 63. The sleeve 64 can be locked by means of a ring 66 which is screwed on the terminal portion of the sleeve 4.

A bush 67 is engaged on the sleeve 64 with a screw coupling, and a transverse element 69 is fixed thereto by means of screws 68; said transverse element comprises two arms which extend diametrically with respect to the shaft 2 and have, at their opposite ends, two further series of casings 70 and 71 which are vertically aligned with the casings 49 and 50 of the underlying series.

Respective rods 72 and 73 are guided in the casings 70 and 71 and are provided, in a median region, with collars 74 for supporting springs 75 accommodated in interspaces defined between the stems of the inner walls of the casings.

The lower ends of the rods 72 and 73 slidingly pass through the ends of the cross-member 47, and bolts 76 and 77, whose heads are suitable for abutting on the top of the stems 53 and 54, are screwed therein.

The bolts 76 and 77 can be adjusted and locked by the lock nuts 78 and 79 which rest on the ends of the cross-member 47 with washers interposed.

As will become apparent hereinafter, the rods 72 and 73 are intended to act, by means of the bolts 76 and 77, on the stems 53 and 54 in order to compact, when required, the powder enclosed in the chambers 61 and to expel the doses thus compacted into the provided containers.

The compaction, if any, and the expulsion of the doses are performed by lowering the element 69 and by acting on the rods with the interposition of elastic means, constituted by springs 80 accommodated in the casings 70 and 71. The springs 80 abut upward on the upper end plate of the casing and abut downward on a ring 81 which rests on an internal shoulder of the casing. In order to expel the compacted doses from the chambers 61 there is a cross-member 82 which is keyed to the top of the shaft 2 and is provided with blocks 83 which are suitable for acting on the rods 72 and 73 and thus on the stems 53 and 54 so as to cause the sliding of the pistons 55 in the chambers 51 and 52.

The operation of the described machine is as follows.

Assuming that the machine must provide compressed doses of powder to be introduced in capsules 84 which are carried at a level overlying the hopper 25 by handling elements 85 arranged outside the tubes 51 and 52.

The drawing shows only the handling elements 85 related to the tubes 51, which are synchronized with the movements of said tubes so that the capsules 84 are moved from a position underlying the tubes 51 and 52, when said tubes are raised to receive the doses of product, to a position which is lateral to said tubes, from which it is possible to advance for effecting the subsequent processing steps.

Furthermore, assuming an operating situation such as the one illustrated in FIG. 1, with the tubes 51 and 52 inserted in the powder product contained in the respective channels 26 and 27 of the hopper 25 until said tubes skim the bottom of said hopper, and with the pistons 55 at the level at which the required volume of the chambers 62 is delimited.

In this situation, the sleeve 4 is actuated downwardly so that a downward thrust is exerted on the rods 72 and 73 and thus on the stems 53 and 54 by means of the springs 80 and compacts the powder contained in the chambers 61. It should be noted that the stroke of the rods 72 and 73 does not correspond to the stroke of the element 79, since it is partially absorbed by the compression of the springs 80.

Once compaction is completed, the pipe 5 and the sleeve 4 are raised simultaneously until the lower edge of the tubes 51 and 52 has reached a level overlying the level of the capsules 84. At this stage the capsules 84 are moved below the respective tubes by means of the handling elements 85. The cross-member 82 is then actuated downwardly and, by pressing on the rods 72 and 73, causes the descent of the stems 53 and 54 into the casings 49 and 50 and the expulsion of the compacted doses of the capsules by the pistons 55. As soon as the capsules have received their respective doses, the containers 84 are removed laterally in direction A in order to avoid interfering vertically with the tubes 5 and 52 which, by actuating the pipe 5 in a downward direction, are then lowered until they move into contact with the bottom of the annular channels 26 and 27 for refilling. The element 69 is also lowered simultaneously to a level at which the pistons 55 delimit the chambers 61, which are filled progressively as the tubes sink into the product contained in the annular channels 26 and 27. In order to ensure uniform weight of the doses, the product of the channels 26 and 27 is maintained at a constant level by a fixed leveling device which is not illustrated in the drawing but is fully imaginable.

A fundamental prerogative of the present invention is constituted by the fact that the hopper 25 is eccentric and is divided by the partition 28 into two annular chambers 26 and 27.

This peculiarity allows to prevent the density differentiations which occur proximate to the tube sinking region from affecting the adjacent layers, thus biasing the dosage when further tubes are sunk into said layers.

A further prerogative of the invention is constituted by the possibility of creating, in the chambers 61, a negative pressure suitable for retaining therein powder products whose physical characteristics do not allow compaction or whose compaction is not sufficient to prevent flaking.

Negative pressure is carried from the tube 36 to the chambers 61 through the annular chamber 35, the tube 45, the passages 44, 43, 58 and 57 and the leakages which occur between the pistons 55 and the tubes 51 and 52. It should be noted that the tube 45, by being sealingly slidable within the disk 29, maintains the pneumatic connection between the chamber 35 and the hole 44 even when the pipe 5, and thus the parts connected thereto, rise with respect to the disk 30.

An advantage of the invention resides in the possibility of adjusting the volume of the chambers 61 by acting on the ring 46, which by being screwed to a varying extent on the bush 38 allows to vary the level of the cross-member 47 and accordingly of the bolts 76 and 77 which, by acting as abutment for the rods 53 and 54, set the level of the pistons 55. Tolerances between the rods can be corrected by performing adjustments on the bolts. Similarly, the product compaction pressure is adjusted by acting on the handwheel 65 so as to vary the initial level of the element 69 and the compression of the springs 80 when the element 69 has reached the upper stroke limit. The appropriately provided graduated column 86 which is fitted on the disk 39 and passes through the cross-member 47 allows to indicate the position of the stems 53 and 54 and thus the volume of the chambers 61, which is adjusted by actuating the ring 46. A second graduated column 87, which extends downward from the element 69 and passes through the cross-member 47, allows to adjust the compression of the springs 80 when acting on the handwheel 65.

The invention is susceptible to numerous modifications and variations, all of which are within the scope of the inventive concept.

Figure 3:
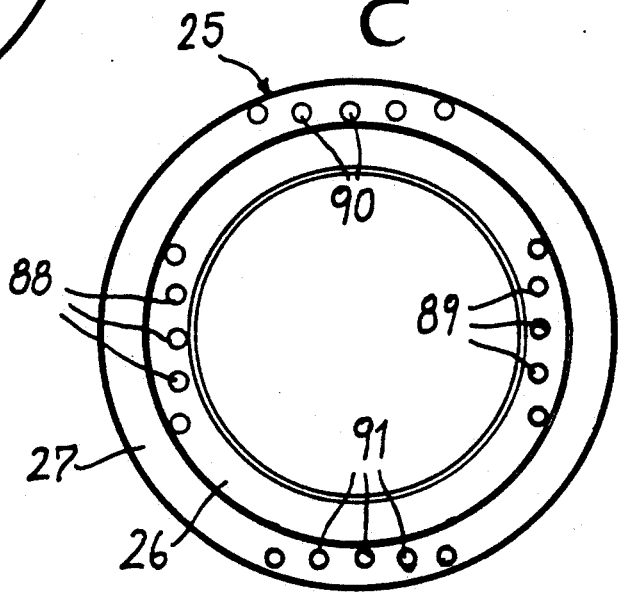

For example, FIG. 3 illustrates the possibility of installing four series of dosage tubes 88, 89, 90 and 91 arranged at right angles with respect to the shaft 2; the diametrically opposite tubes 88 and 89 both draw powder product from the same annular channel of the hopper 25, while the diametrically opposite tubes 90 and 91 draw the powder product from an outer channel 27 arranged concentrically with respect to the channel 26.

Figure 4:
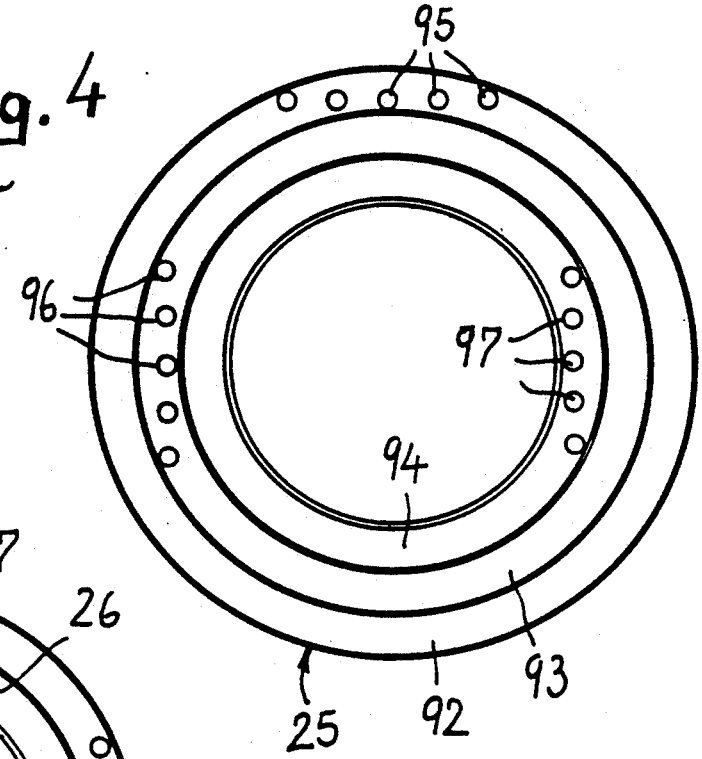
FIGS. 3 and 4 are plan views, similar to those of FIG. 2, of further embodiments of the machine according to the invention.

It is in any case always possible to make each series of tubes draw the powder product from a channel of its own, even in the case of three or more series of tubes, as illustrated for example in FIG. 4, where the hopper 25 is divided into three concentric annular channels 92, 93 and 94, a respective series of tubes 95, 96, 97 being associated with each of the channels 92, 93 and 94.

I claim:

1. Machine for the dosage and introduction of powder products in containers, wherein it comprises a substantially vertical central shaft, a sleeve guided on said central shaft and a pipe guided on said sleeve, said shaft, said sleeve and said pipe being movable along strokes which are appropriately mutually synchronized, a support for at least two series of vertical and parallel casings being associated with said pipe, respective dosage tubes being rigidly associated coaxially to said casings in a downward position, respective stems being guided in said casings, said stems being provided, in a downward position, with pistons which are guided in said tubes and define dosage chambers, means for slidingly supporting on said sleeve an equal number of series of rods which are coaxial to said stems and have one end operatively associated with the top of each stem, actuation means for actuating in succession the descent stroke to said sleeve and said pipe so as to cause the insertion of the series of tubes in respective annular channels of a hopper mounted around said sleeve in order to fill the dosage chambers with doses of product, an ascent stroke of said pipe and said sleeve suitable for lifting the tubes out of the hopper above a plurality of containers for receiving the doses of product, and finally a descent stroke of the central shaft suitable for moving abutments fixed to said central shaft so that they act on said rods so as to cause the descent of the pistons in order to expel the doses into the underlying containers, actuation means being finally provided for rotating said hopper about said sleeve.

2. Machine according to claim 1, wherein said annular hopper is eccentrically supported about said shaft and is divided by concentric partitions into annular channels which are open upward and in which respective series of tubes can be inserted.

3. Machine according to claim 2, wherein said pistons are actuated so as to perform a stroke for the compaction of the powdery product when the series of tubes have entered the respective annular channels of the hopper.

4. Machine according to claim 1, wherein said dosage chambers are connected to suction means which are actuated so as to aspirate the powdery product contained in the dosage chambers during the ascent stroke of the tubes.

5. Machine according to claim 1, wherein a cross-member is rigidly associated with said tubes and acts as abutment for said rods, means being provided for keeping said stems in abutment with said rods.

6. Machine according to claim 5, wherein said means for supporting said rods on said sleeve comprise, for each rod, a casing in which said rod is slidingly guided, a first spring which is accommodated in said casing and actuates said rod in a position of abutment on said cross-member, a second spring which is accommodated in said casing and acts as elastic abutment for said rod when the sleeve is actuated in the direction in which said rod acts on the stem which is coaxial thereto for the expulsion of the product from the related tube.

* * * * *